United States Patent [19]

Nilsson et al.

[11] Patent Number: 4,543,808

[45] Date of Patent: Oct. 1, 1985

[54] APPARATUS FOR WINDING WIRE ON A SPOOL

[75] Inventors: Rolf Nilsson; Håkan Björnfoth, both of Karlskoga, Sweden; Knut Slungaard, deceased, late of Karlskoga, Sweden, by Kerstin Åberg, Guje Slungaard, legal representatives

[73] Assignee: AB Bofors, Bofors, Sweden

[21] Appl. No.: 572,490

[22] Filed: Jan. 20, 1984

[30] Foreign Application Priority Data

Jan. 20, 1983 [SE] Sweden ..... 8300269

[51] Int. Cl.[4] ..... B21F 3/04; B21F 21/00

[52] U.S. Cl. ..... 72/137; 72/142

[58] Field of Search ..... 72/135, 137, 142, 144, 72/145, 146, 148; 242/7.15, 7.16, 7.21, 25 R, 158 R, 158.2, 158.4 R

[56] References Cited

U.S. PATENT DOCUMENTS

| | | | |
|---|---|---|---|
| 865,803 | 9/1907 | Row | 72/137 |
| 1,117,620 | 11/1914 | Adams | 242/25 R |
| 1,471,634 | 10/1923 | Thronsen et al. | 242/25 R |
| 1,587,998 | 6/1926 | Adams | 242/158 R |
| 2,165,411 | 7/1939 | Peyton | 72/142 |
| 2,229,462 | 1/1941 | Kurtz | 72/137 |
| 2,360,047 | 10/1944 | Caminez | 72/142 X |
| 2,740,594 | 4/1956 | Stevens | 242/158 R |
| 4,150,901 | 4/1979 | Ikegami et al. | 242/158 R |

FOREIGN PATENT DOCUMENTS

| | | | |
|---|---|---|---|
| 1574422 | 7/1967 | Fed. Rep. of Germany . | |
| 483356 | 4/1938 | United Kingdom . | |
| 714208 | 8/1954 | United Kingdom . | |
| 837756 | 6/1960 | United Kingdom | 72/144 |
| 1194825 | 6/1970 | United Kingdom . | |
| 1270819 | 4/1972 | United Kingdom . | |
| 1439429 | 6/1976 | United Kingdom . | |
| 1564142 | 4/1980 | United Kingdom . | |

*Primary Examiner*—E. Michael Combs

*Attorney, Agent, or Firm*—Pollock, Vande Sande & Priddy

[57] ABSTRACT

A mechanism to be utilized for winding wire on a spool in tight coils without space between them. The mechanism includes rotating devices (14) and (16) which when activated rotate the spool (12) about its longitudinal axis (13). A wire guiding unit is arranged to be automatically moveable in all directions to the side of the thus rotating spool. The unit comprises a pressure roller (2) or equivalent which with a predetermined force presses that section of wire which during winding runs inwards at an angle against that section of wire which comprises the previous coil of wire in the layer being wound. During winding the pressure roller (2) adjoins and presses the section of wire being wound against the last wound coil of wire and the mantle surface of the spool or the already wound underlying layer of wire.

13 Claims, 3 Drawing Figures

APPARATUS FOR WINDING WIRE ON A SPOOL

TECHNICAL FIELD

This invention relates to a mechanism for winding wire on a spool in tight coils without space there between, and comprises a spool rotating device which when activated rotates the spool about its longitudinal axis. In this context is meant such spools and wire as are intended for use with missiles which are guided via the said wire.

BACKGROUND OF THE INVENTION

Wire intended for wire-guided missiles contains one or more inner strands of electricity conducting material e.g., copper, and an insulating material around the said strands. In this context the wire can be more or less inflexible and manufacturing irregularities may be present. This means that it can be difficult to achieve layers of wire lying on top of each other where the coils are so close that no space (distance) or tendency to space is present between them and thus no penetration of an upper coil wire into the layer of wire underneath. It is important that such penetration be prevented partly for functional reasons which demand a purpose-correct unwinding of the wire from the spool and partly for reasons of space which demand that the least possible winding volume for a given length of wire can be obtained.

Mechanisms and methods at present in use for winding wire on a spool have not completely solved the problems described above but have caused a certain scrapping during manufacturing and in addition have been technically relatively complicated as regards handling. The latter has in turn meant among other things relatively time consuming and costly manufacturing.

DISCLOSURE OF THE INVENTION

The principle purpose of this invention is to create a mechanism which solves those problems described above. A characteristic of the mechanism according to the invention is consequently that a wire guiding unit is designed to slide automatically in a predetermined movement pattern in accordance with the form of the wire wound on the spool and to the side and around the said spool. Another characteristic of the mechanism according to the invention is that the unit incorporates a device which is interactable with the wire. The said device being preferably in the form of a pressure roller which with a preset pressure and at a preset angle presses that section of wire which is currently being wound into a coil against that section of wire which forms the previously wound coil as the device stations itself close simultaneously to the previously wound coil of the same layer and to the spool mantle surface (when winding the first coil) or to the already wound underlying layers of wire.

Further developments of the principle of the invention utilize the design of the wire guiding unit. In this context, the unit is equipped with two pressure rollers or devices which can coordinate with the wire and each of which has its own direction of movement along the rotating spool. In this way each of the pressure rollers guides the wire with the aid of a specifically formed guide groove located on the peripheral edge surface of the pressure roller. The said pressure rollers are so arranged as to press the wire against that part of the wire in the previous wound coil of wire of the same layer and against the spool body surface or the previously wound layer of wire at a preferred angle of approximately 45°. The pressure rollers are springloaded against the wire.

To ensure that the wire runs over the pressure rollers, the mechanism also includes a guide roller for each pressure roller.

The guide groove in each pressure roller is provided with relative to each other, angled and preferably flat sides.

The design as described above permits the mechanism to be easily fitted on a suitable winding machine and to be controlled by an already known type of control equipment. The pressure rollers can be individually adjusted to suit a particular wire.

In cases where the wire is relatively elastic radially, the circular cross section of the wire can be reformed to become in principle a square while the wire is being wound on the spool. The said pressure rollers and guide wheel can easily be arranged as an automatic function. By means of specially controlling the movement direction of the mechanism and the pressure and guide rollers, the winding direction can be made to change automatically. Furthermore the control equipment can be arranged so that a desired form, such as trapezoidal, can be given to the winding.

BRIEF DESCRIPTION OF DRAWINGS

A proposed design for a mechanism according to the invention which illustrates the significant characteristics of the invention is desribed below while simultaneously referring to the enclosed drawings where FIG. 1 at an angle from above shows in perspective the mechanism with associated pressure and guide rollers together with their control equipment.

DESCRIPTION OF BEST MODE AND OTHER EMBODIMENTS

Figure 1:
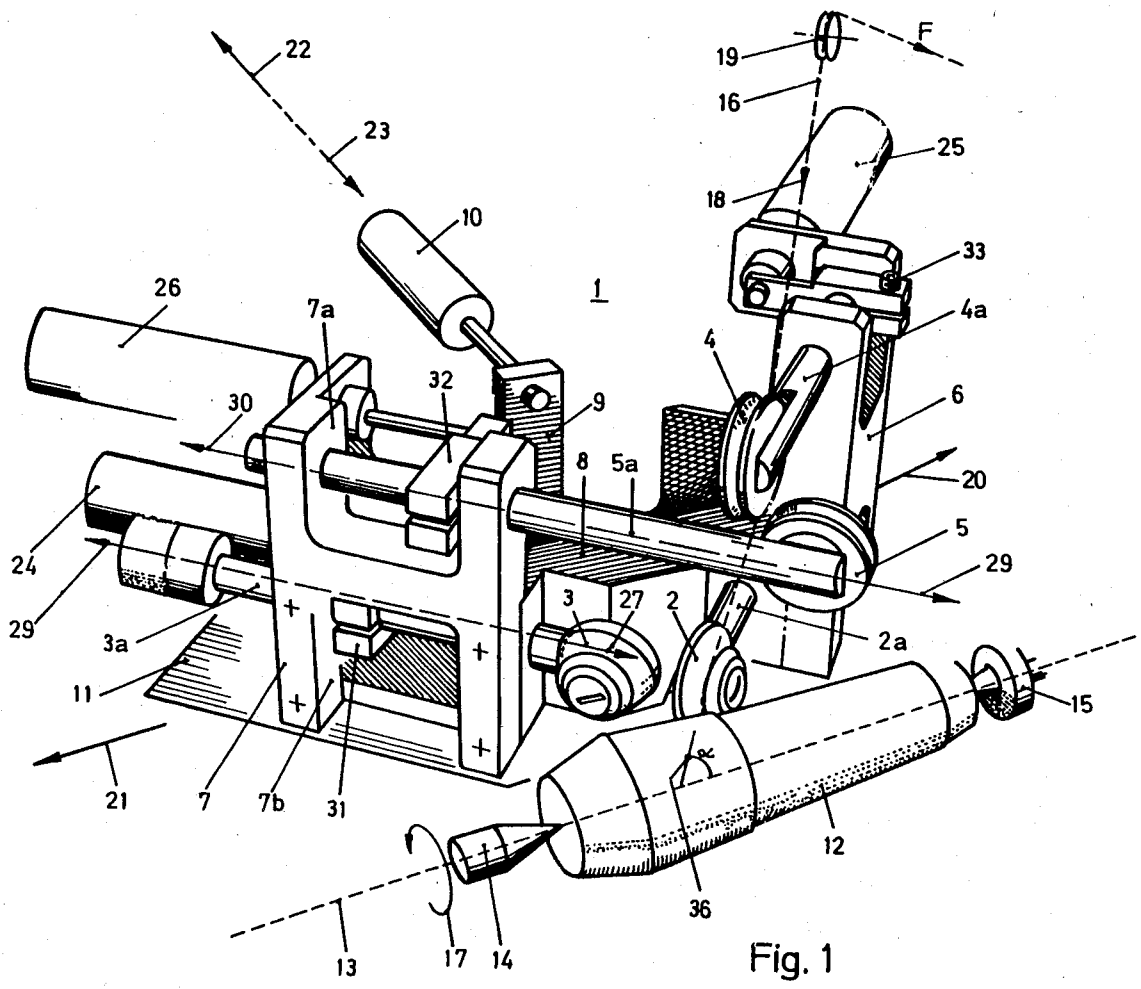
FIG. 1 also shows the location of the mechanism relative to a spool fitted on a rotating device with a coil of wire being partly wound on the spool, FIG. 2 in a horizontal view shows the design of the pressure rollers, and FIG. 3 in enlargement shows the arrangement of the wire on the spool using the pressure roller as shown in FIG. 2.

In a unit (1) are mounted two pairs of pressure and guide rollers (2), (4), (3), and (5) respectively. The first pair of pressure and guide rollers (2) and (4) are mounted in a support (6) and the second pair of pressure and guide rollers (3) and (5) are mounted in another support (7). The supports (6) and (7) are arranged at an angle of 90° relative to each other and are joined by a connecting body (8). The unit is also equipped with a bracket (9) for a control equipment (10) for the unit's positioning movements towards and away from a spool during winding. The unit is mounted on a base (11) which is moveable in relation to the spool which is numbered (12). This spool is rotatable around its longitudinal axis (13) by means of already known rotating devices (14) and (15). The latter rotating device can be included in an already known winding machine in which the spool can be fitted and rotated when winding a wire (16). The winding machine's rotating device includes a motor (not shown) of already known type. The spool (12) rotates in a counter-clockwise direction which is indicated in the figure by the arrow (17). The feed-in direction of the wire is indicated by the arrow

(18) and a tensioning force on the wire is indicated by the letter (F). The wire emerges from a wire magazine (not shown) which may be of an already known type. The wire (16) runs from the wire magazine in and over the unit via a pulley wheel (19) so that the wire enters the guide roller (4) in a mainly vertical direction.

The unit (1) is designed to be moveable in all directions along the rotating spool (12). The movement directions of the unit (1) are indicated in the figure by the arrows (20) (21), (22), and (23). The arrow (20) thus shows the initial movement direction which is mainly parallel with the winding axis (13) of the spool, and the arrow (21) shows a movement direction which is mainly opposite to that of (20). The arrows (22) and (23) indicate movement directions which are at right angles to the winding axis (13) and which are effected by means of the control equipment (10). Control of the unit can be carried out by means of already known control equipment such as numerically controlled equipment and thus achieve great accuracy.

The pressure rollers (2) and (3) and the guide rollers (4) and (5) are mounted in their supports on longitudinally adjustable spindles (2*a*), (3*a*), (4*a*), and (5*a*) respectively. Longitudinal adjustment of the spindles is accomplished by control devices. Only the control device for the pressure roller (3) is shown in the figure and it has been designated (24). The pressure roller (2) is equipped with an equivalent control device. The control device for the guide roller (4) is indicated at (25). The longitudinal movement directions of the pressure roller (3) are indicated by arrows (27) and (28) while the movement directions for the guide roller (5) are indicated by arrows (29) and (30). Equivalent movement directions are relevant for the pressure roller (2) and its associated guide roller (4). The pressure rollers (2) and (3) are designed to be spring-loaded against the wire running down from the guide rollers (4) and (5) above and against the already wound wire coils of the same layer the underlying wire coils or the spool mantle surface (when winding the first layer of wire). The spring-loading is achieved with the aid of a spring function built into the control device (10). The above-mentioned control devices (10), (24), (25), and (26) are operated by a suitable media such as air, hydraulic oil, or similar. The pressure rollers (2) and (3) and the guide rollers (4) and (5) function with distinct end positions which are created by the end stops (31) and (32) which in turn function together with the opposite direction stop surfaces of the supports (6) and (7). Two of the stop surfaces are indicated in the figure by the symbols (7*a*) and (7*b*). The end stops can if so required be made adjustable by means of the adjustment device (33) for example.

Figure 2:
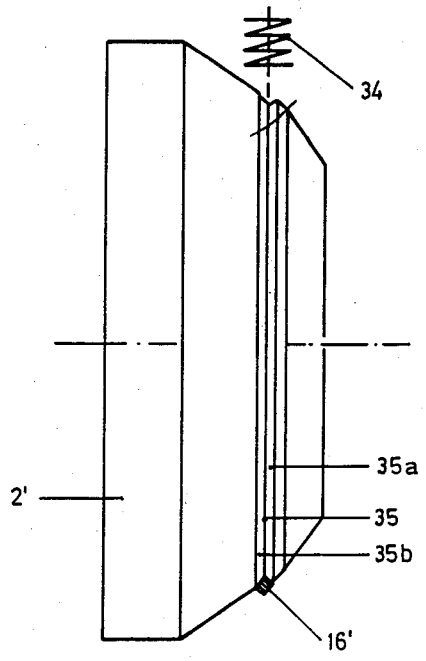

FIG. 2 shows the pressure roller (2') in more detail. The figure also shows a spring device (34) which presses the pressure roller against the section of wire (16') with a pre-determined force which can be adjusted by means of already known methods. The said pressure roller is furnished with a guide groove (35) located at its peripheral end surface around which guide groove extends. The guide groove walls (35*a*) and (35*b*) in the shown view are in principle flat and placed at right angles to each other. The wire 16' in the shown mode example is assumed to be of the type that is elastic in its radial direction. The flat and at right angles to each other placed guide groove surfaces will thus impart to the section of wire 16' a similar form to the relevant parts of the circumference of the wire.

Figure 3:
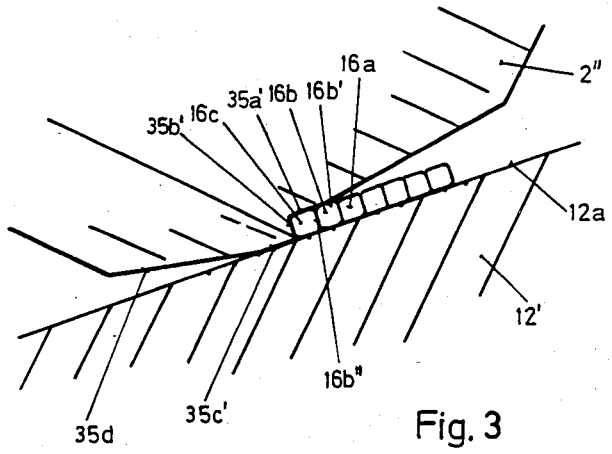

In accordance with FIG. 3 the relevant type of wire will be given a four-cornered or quadratic cross section on sections (16*a*) and (16*b*) on previously wound coils of wire. FIG. 3 indicates the part of the wire which runs in during the winding of a wire coil as (16*c*). The wire part (16*c*) is packed tightly against the already wound wire coil (16*b*) by the pressure roller 2''. The wire coil (16*b*) in the course of being wound has been given the right-angled profiles (16*b*') and (16*b*''). During the course of being wound the wire part (16*c*) will be given a four sided rectangular or quadratic shape which is determined by flat surfaces at right angles to each other, namely, flat surfaces (35*a*') and (35*b*') on the pressure roller 2'', the side surface (16*b*'') of the already wound wire coil (16*b*), and the mantle surface (12*a*) of the spool (12') or on the upper surface (16*b*') of one or two underlying wire coils of an already wound layer of wire.

During the course of winding, the outer surface (35*c*') of the pulley wheel will thus adjoin or press against the mantle surface (12*a*) or upper surfaces (16*b*') of already wound layers of wire. Due to the form of the wire being altered from its original circular cross section to a quadratic or four-cornered cross section a very high density of tightness between the wire coils (16*a*) and (16*b*) is achieved and to all intents and purposes all space between the wire coils is eliminated. In this context no tendency to slackness will be present between the sections of wire in the various wire coils. In this respect it can also be said that the mantle surface of the wire may be coated with glue which is moisturized by the wire during winding and so contributes to ensuring that the wire coils are kept in their allotted positions during winding. The glue should be of a type which does not negatively affect the unwinding function. The flat surface (35*a*') is not only intended to form the section (16*c*) of the incoming wire part but is also intended to hold down the incoming wire part. The flat surface (35*c*') is joined to another flat surface (35*d*) which extends at a slight angle outwards from the already wound wire coils. The control equipment which controls the unit (1) thus functions with a pitch which is rather less than the diameter of the pliable wire.

In accordance with the above each pressure roller is allocated a longitudinally moveable direction which results in an angle $\alpha$, between a plane (36) (see FIG. 1) defined by the bottom line of the groove (35) and the longitudinal axis of the spool, of approximately 45°. It is of course possible to permit the equipment to function with other angles of incidence for the pressure rollers in which case angles of incidence of between 20°–80°, preferably 30°–60° are relevant.

Each wheel of the pressure rollers and guide rollers is mounted so as to be self-rotatable. The rate of feed for the unit (1) is dependent on the side of each section of a wire coil. One pressure roller and guide roller pair (2) and (4) function during the first movement direction (20) (to the right in FIG. 1) while the other pressure roller and guide roller pair (3) and (5) function during the second movement direction (21). In this case each upper layer of wire in the winding shall be two coils shorter at each relevant end than the underlying layer of wire. When the unit (1) reaches the end of a layer it stops due to a stop signal from the control equipment two coils from the end of the previous layer, afterwhich a change signal is given to the unit by the control equipment. This change signal initiates a change between the pairs (2) and (4) and (3) (5) which can occur as follows;

It is assumed that the unit (1) has moved to the right in FIG. 1 and that the pressure roller (2) and the guide roller (4) have thus functioned and that change over shall take place to pressure roller (3) and guide roller (5). The guide roller (4) is moved longitudinally forward from a rear position so that the wire is freed. The control equipment (10) which functions during winding to compress the spring (34) then pulls the unit (1) free from the wire and the winding/spool. The pressure roller (2) is moved longitudinally backwards in its mounting from a forward position. The pressure roller (3) is moved longitudinally forwards from its rear position. The entire unit (1) is then moved against the spool or the winding thereon so that the pressure roller (3) lies against the mantle surface or the surface of the winding. The guide roller (5) which during the above sequence has assumed its forward position is moved rearwards to its rear position and thus catches the wire section (16) and enters it in the groove (35) on the pressure roller (3). Winding in the other movement direction (21) (to the left in FIG. 1) can now be commenced. The forward position of the pressure rollers (the winding position) is adjusted so that a side movement of the wire equivalent to two coils is obtained when changing direction. In this way an automating reduction is achieved at the end of each layer and in this case the spool receives the desired trapezoidal form. This forward position is adjustable to suit other reductions or a straight end if so required.

The mechanism described above can be used for other types of wire e.g., even such wire types that are not elastic but which retain their mainly circular cross section when wound on the spool. The space formed by the groove surfaces on the pressure rollers or equivalent and the adjoining and underlying coils of wire and mantle surface respectively can thus receive a different form. The tensioning force F can even be altered to suit from case to case. The guide groove (35) on the pressure roller can thus be given a different form.

This invention is not limited to the above described mechanism but can be modified within the scope of the patent claims and the principle of the invention.

What is claimed is:

1. An apparatus for winding a wire onto a spool, said wire being elastic in its radial direction and having a cross-sectional shape other than substantially rectangular before said winding, said apparatus comprising:

rotation means for rotating said spool about a longitudinal axis and for causing said wire to wind on said spool during said rotation thereof;

at least one pressure roller mounted for reciprocal movement relative to the longitudinal axis of said spool and for rotation about an axis transverse to the direction of said reciprocal movement;

a peripheral groove in an outer face of said roller for interacting with a previously wound coil of a layer of wire being wound on said spool and with an underlying surface of said spool or a previously wound layer of said wire so as to provide a wire shaping space having a substantially rectangular cross-sectional shape, said peripheral groove having a bottom line defining an imaginary plane intersecting the longitudinal axis of said spool at an acute angle; and, pressing means for causing said at least one pressure roller to press a portion of said wire being wound onto said spool into said wire shaping space at a pressure altering the cross-section of said wire portion from said before winding cross-sectional shape to a substantially rectangular cross-sectional shape corresponding substantially to said substantially rectangular cross-sectional shape of said wire shaping space, said wire portion being pressed by said groove at said pressure simultaneously against said previously wound coil of the layer of wire being wound on said spool and against said underlying surface of said spool or said previously wound layer of said wire so as to provide tight coils of said wire without significant space between adjacent coils.

2. The apparatus according to claim 1 in which said apparatus has two of said pressure rollers positioned on the same side of said spool each having said peripheral groove in an outer face thereof, one of said pressure rollers being arranged with the bottom line of its peripheral groove defining a first imaginary plane for winding said wire onto said spool in one direction relative to the longitudinal axis of said spool and the other of said pressure rollers being arranged with the bottom line of its peripheral groove defining a second imaginary plane for winding said wire onto said spool in an opposite direction relative to the longitudinal axis of said spool so as to provide on said spool multiple layers of tight coils without significant space between coils adjacent to each other both axially and radially relative to said spool axis.

3. The apparatus according to claim 2 in which said at least one pressure roller includes an outer surface adjacent to an edge of said groove, said outer surface being positioned to press against said underlying surface of said spool or said previously wound layer of said wire so as to define the thickness of the wire layer being wound on said spool.

4. The apparatus of claim 1 which further includes guide means for guiding into said groove the portion of said wire being wound onto said spool.

5. The apparatus of claim 1 in which said actue angle between the longitudinal axis of said spool and the imaginary plane defined by the bottom line of said annular groove is within the range of 20° to 80°.

6. The apparatus of claim 5 in which said acute angle is in the range of 30° to 60°.

7. The apparatus of claim 5 in which said acute angle is approximately 45°.

8. The apparatus of claim 1 in which said pressing means comprises a spring device for applying a predetermined force to said at least one pressure roller so that said pressure roller presses into said wire shaping space the portion of said wire being wound onto said spool.

9. The apparatus of claim 1 in which the winding of said wire onto said spool is controlled by numerically controlled equipment.

10. The apparatus of claim 1 in which said at least one pressure roller is mounted for reciprocal movement on a support and the length of said reciprocal movement is adjustable relative to said support.

11. The apparatus of claim 4 in which said at least one pressure roller and said guide means are each mounted on a support for reciprocal movement, in which said apparatus further includes means for reciprocating said at least one pressure roller and said guide means, and in which said reciprocating means is operated by a fluid such as air, hydraulic oil or equivalent.

12. The apparatus of claim 11 in which the length of said reciprocal movement of said at least one pressure roller and the length of said reciprocal movement of said guide means are each adjustable.

13. The apparatus of claim 1 in which said groove has two substantially flat walls one substantially perpendicular to the other so that said groove cooperates with a substantially flat side surface of an already wound coil of the same layer as the portion of wire being wound on said spool and with a substantially flat surface of said spool or said previously wound layer of said wire so as to provide a four-sided wire shaping space for giving a four-cornered substantially quadratic cross-section to said portion of said wire being wound on said spool.

* * * * *